US006072128A

United States Patent [19]

Ansorge et al.

[11] Patent Number: 6,072,128

[45] Date of Patent: Jun. 6, 2000

[54] MULTIPOLE ELECTRIC SWITCH

[75] Inventors: Rainer Ansorge, Marienheide; Andreas Cramer, Gummersbach, both of Germany

[73] Assignee: Schneider Electric SA, Boulogne Billancourt, France

[21] Appl. No.: 09/030,003

[22] Filed: Feb. 25, 1998

[30] Foreign Application Priority Data

Feb. 26, 1997 [DE] Germany ..... 197 07 563

[51] Int. Cl.[7] ..... H01H 3/32

[52] U.S. Cl. ..... 200/5 R; 200/16 A; 200/18; 200/243; 200/307; 200/572

[58] Field of Search ..... 200/16 A, 243, 200/572, 18, 17 R, 293–307; 439/712

[56] References Cited

U.S. PATENT DOCUMENTS

| | | | |
|---|---|---|---|
| 2,498,614 | 2/1950 | Tregoning | 200/16 A X |
| 2,532,305 | 12/1950 | Heller | 200/16 A X |
| 2,918,554 | 12/1959 | Brauneck | 200/243 |
| 2,947,827 | 8/1960 | Bundy et al. | 200/16 A |
| 3,226,516 | 12/1965 | Kussy et al. | 200/307 |
| 3,517,570 | 6/1970 | Kolb | 74/527 |
| 3,919,506 | 11/1975 | Kellogg | 200/16 A |
| 4,335,288 | 6/1982 | Ludwig et al. | 200/307 |
| 4,713,498 | 12/1987 | Ludwig et al. | 500/16 A X |
| 5,299,957 | 4/1994 | Schaeffer | 439/712 |

FOREIGN PATENT DOCUMENTS 0219570 4/1987 European Pat. Off. .

*Primary Examiner*—J. R. Scott

*Attorney, Agent, or Firm*—Oblon, Spivak, McClelland, Maier & Neustadt, P.C.

[57] ABSTRACT

Rotary-controlled multipole electric switch fitted with a handle (4) and a housing (1) in which a cam device transforms the rotation of the handle into a translational movement of contact bridges (21). In order to ensure coordination between a cylindrical control core (13) and a slider 16 bearing contact bridges, the cam device is fitted with at least two notches (19, 20) offset around the axis of rotation X of the knob **(4*c*), and with a control projection (14) applied respectively to the bottom of one notch in the OFF position and to the bottom of the other notch in the ON position by the force supplied by springs (24) acting on the slider and contact pressure springs (22)**.

9 Claims, 5 Drawing Sheets

MULTIPOLE ELECTRIC SWITCH

BACKGROUND OF THE INVENTION

The present invention relates to a rotarycontrolled multipole electric switch, particularly of the isolator switch type, that comprises a housing fitted with a control handle with a rotating knob that houses several movable contact bridges disposed in a slider that coordinate with fixed contacts, said slider being capable of translational movement initiated by the knob via a cam device that has a common core with the rotating knob.

This type of switch is described in U.S. Pat. No. 4,713,498. When the knob is moved from an OFF position to an ON position, the slider moves from a position remote from the knob, in which the contact bridges are separated from the fixed contacts, to a position close to the knob in which the contact bridges are applied to the fixed contacts. It is worth simplifying the switch described when it is small in size. It is also particularly desirable to simplify the construction and assembly of this type of switch while reducing its dimensions.

BRIEF SUMMARY OF THE INVENTION

The aim of the present invention is therefore to simplify the construction and facilitate the assembly of a switch of the type described. It is a further aim to reduce the height of the switch while retaining considerable operating flexibility.

According to the invention, in order to ensure that the core coordinates with the slider, said cam device is provided with at least two notches, for example two pairs of notches offset around the axis of rotation of the knob, and with at least one control projection, for example a pair of such projections, applied respectively to the bottom of one notch in the OFF position and to the bottom of the other notch in the ON position by the force supplied by springs acting on the slider.

The construction of the switch is thus greatly simplified, particularly when the slider comprises grooves that open facing the knob that house and guide the contact bridges, contact pressure springs pressing on the housing and on the bridges and assisting in pressing the control projection between the notches. The dimensions of the main axis of the switch, i.e. parallel to the axis of rotation of the knob of the handle, are thereby reduced.

The notches are preferably of different depths in a main axis of the switch parallel to the axis of rotation of the knob, and the projections and notches are located on the cylindrical core and on a receptacle head that is also cylindrical, the core and the head being of roughly similar size.

Connection terminals accessible from the front and back of the main axis of the switch may advantageously be provided in the housing. Said terminals may be flexible and preferably consist of two coaxial screws coordinating with a single cage into which a fixed contact component penetrates.

The housing may be composed of a base and a body, each connection terminal having an aperture provided in the front of the switch in the body and an aperture provided in the rear of the switch in the base. The body may be provided with lateral cavities housing the terminals and closed when the body is inserted into the base.

The housing may include a passage for an activating rod for the handle, one surface of the handle being fitted with ratchets to coordinate with flexible ratchet components located in the passage thereby enabling several handles to be attached to the same housing.

BRIEF DESCRIPTION OF THE DRAWINGS

The characteristics and advantages of the invention will be understood from the following description of a non-limitative embodiment.

FIG. 3*a* shows a reversible add on.

DETAILED DESCRIPTION OF THE INVENTION

The electric device shown in the figures is an isolator switch suitable for being fitted to supports such as standard sections, electric units or cabinets, machine plates or bodies. It comprises a roughly rectangular box-shaped housing 1 composed of two main section, namely a base 2 and a body 3 that may be inserted into the base and retained inside it by ratchet components (not shown) together with a control knob or handle 4 capable of rotating around an axis X. The housing has a main axis X' parallel to X.

Figure 1:
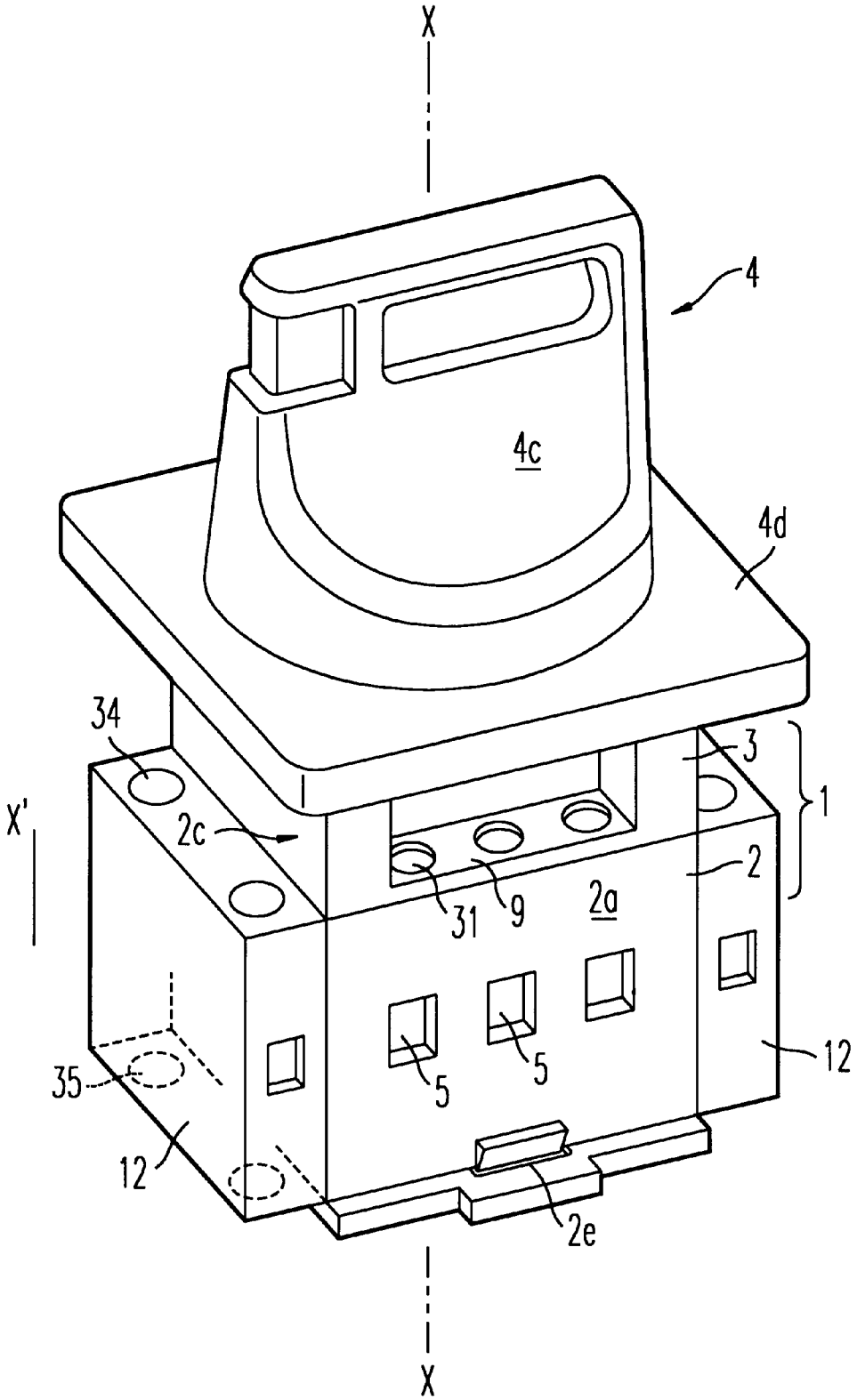
FIG. 1 is a perspective view of an isolator switch according to the invention.
Figure 2:
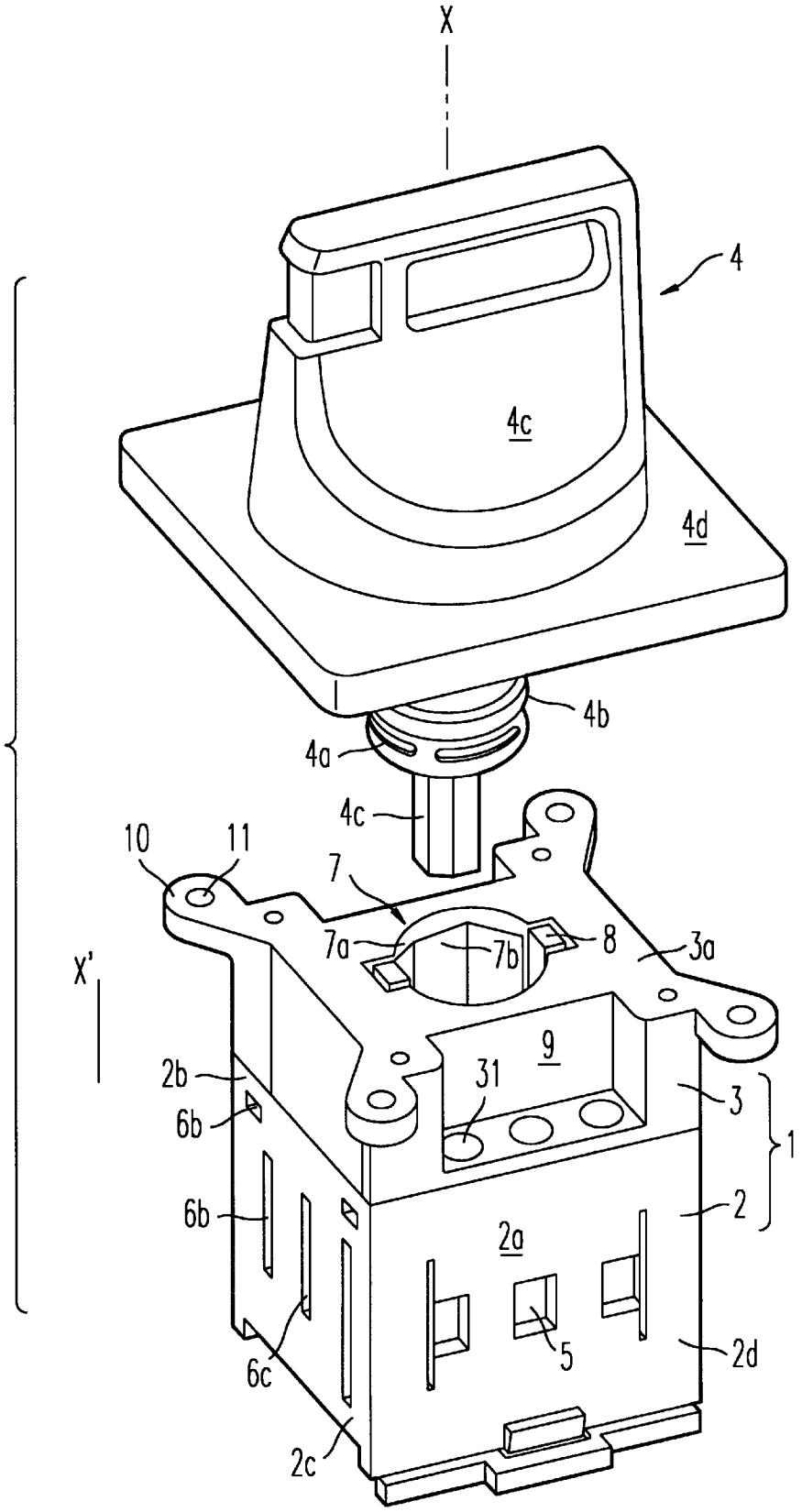
FIG. 2 shows the switch with its rotating control head removed.
Figure 3:
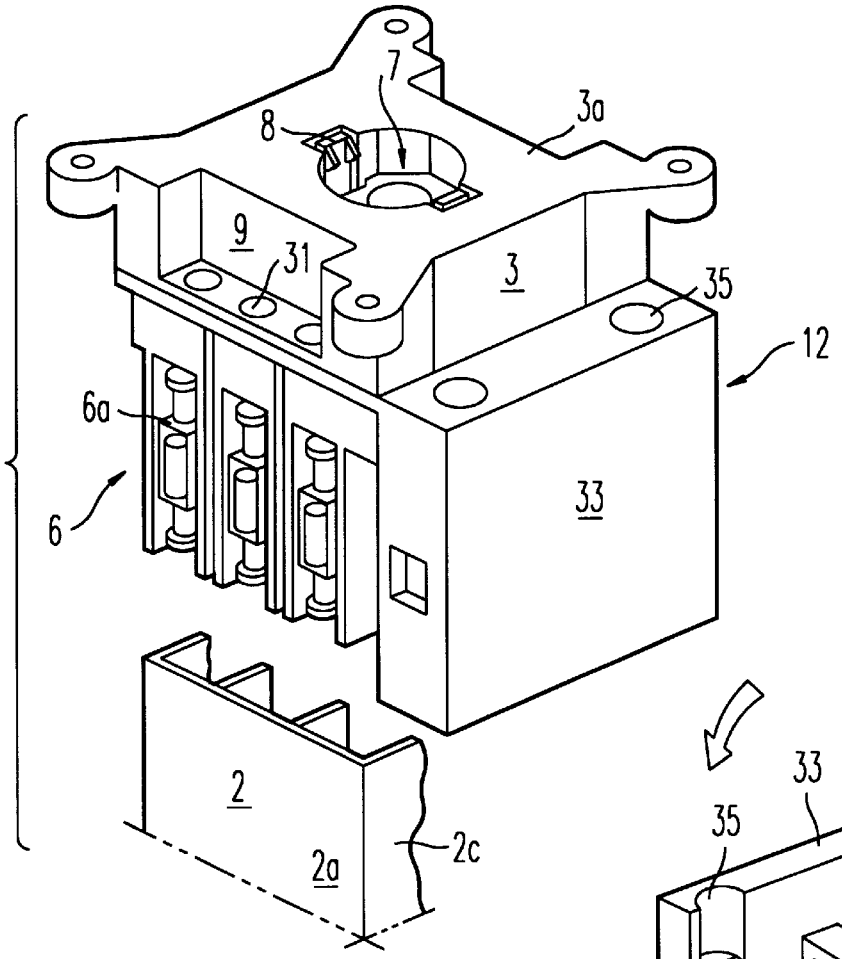
FIG. 3 shows part of the switch.
Figure 3A:
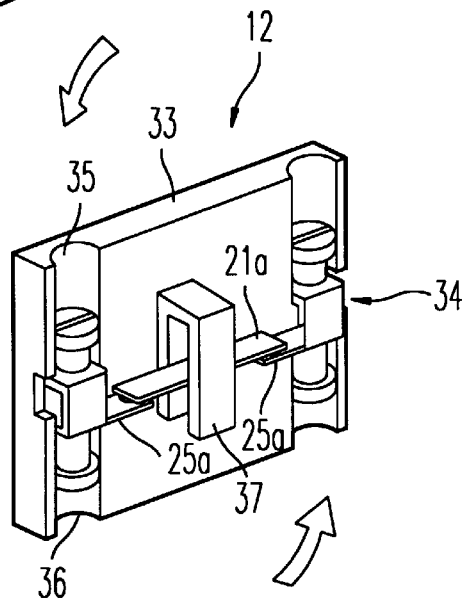
Figure 4:
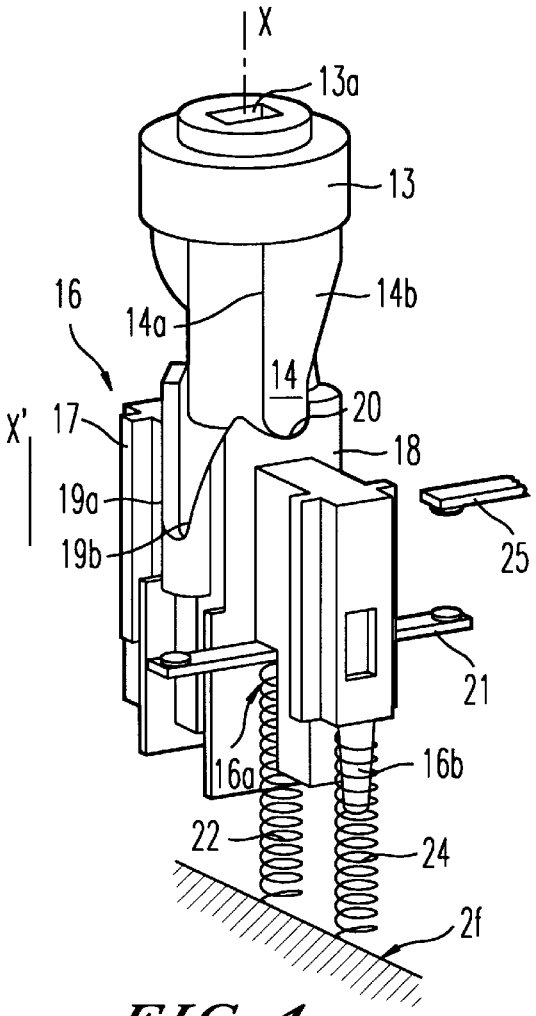
FIGS. 4 and 5 respectively show the slider and the contact bridges in the OFF and ON positions.
Figure 5:
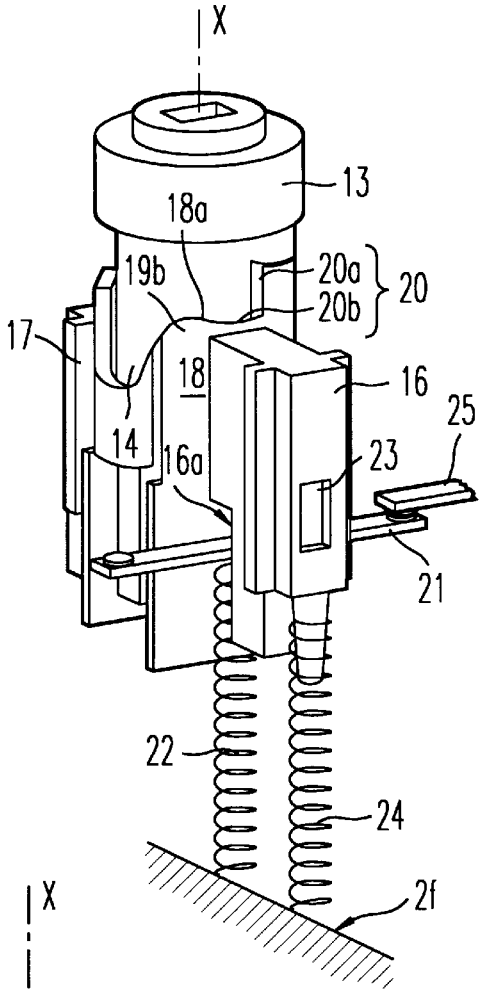
Figure 6:
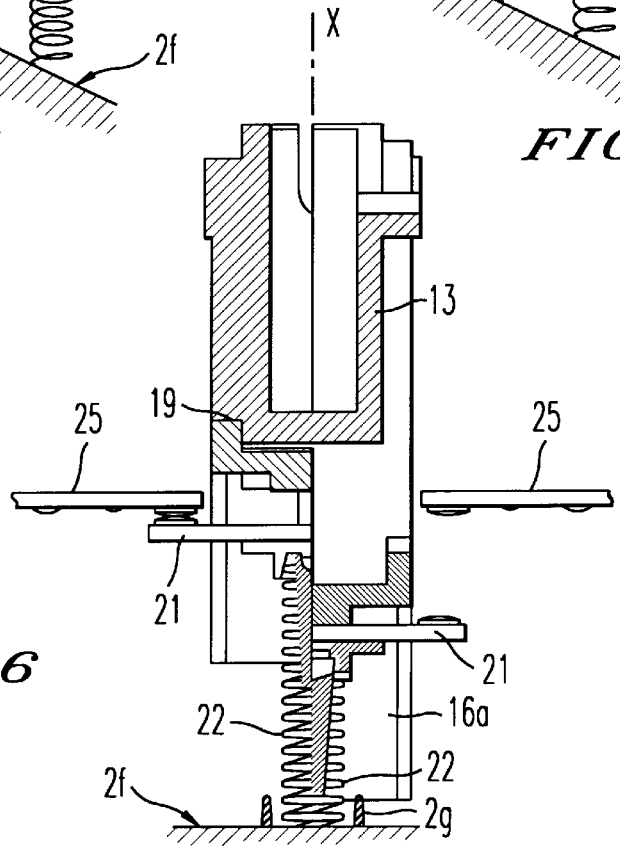
FIG. 6 shows a cross section through the same components; in the left-hand half of the drawing the switch is in the OFF position and in the right-hand half it is in the ON position.
Figure 7:
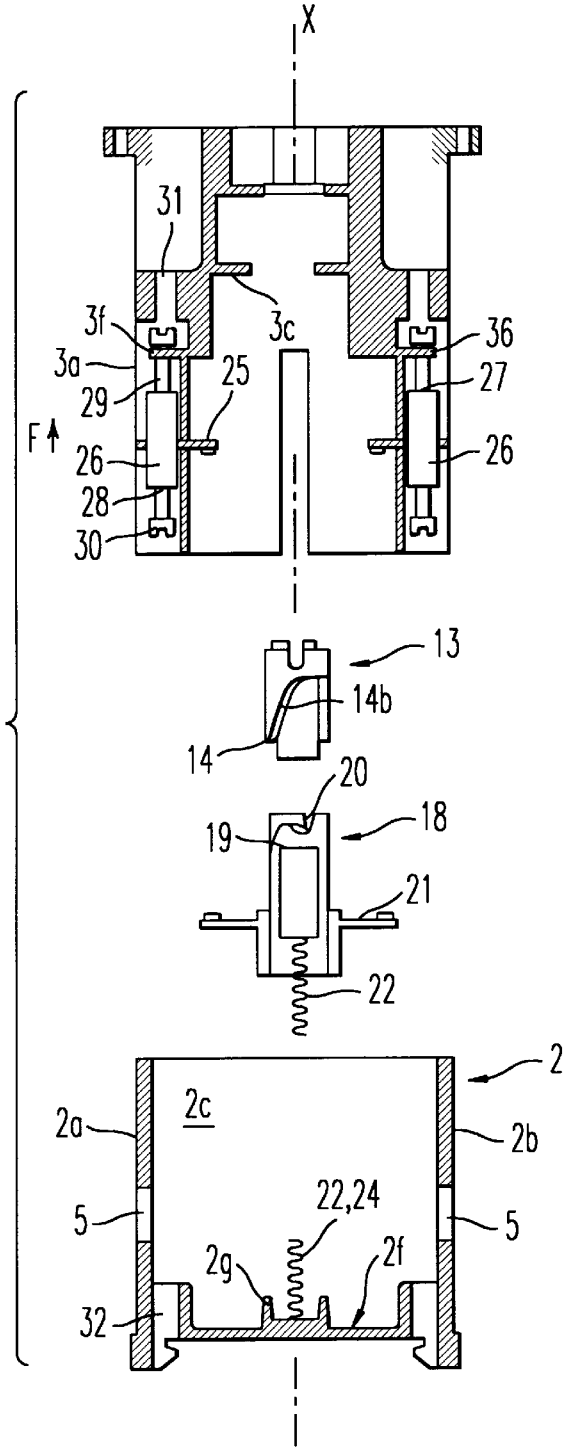
FIG. 7 is an exploded schematic cross section of the switch.
Figure 8:
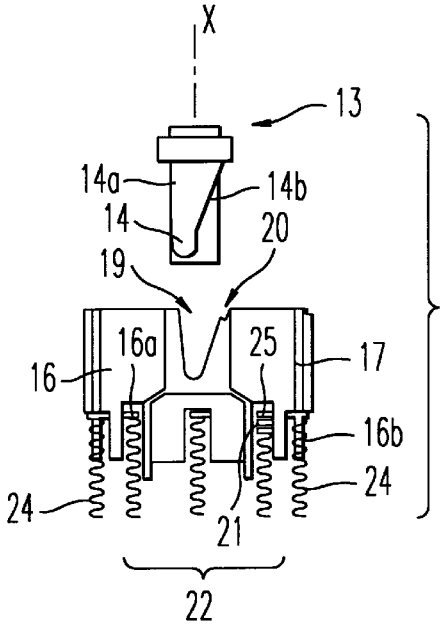
FIG. 8 is a view along line VIII—VIII of the slider and its control core.

Two facing surfaces 2*a*, 2*b* of base 2 are fitted with pull-through apertures 5 for the cables connecting to terminals 6 housed in cavities 6*a* of body 3 and covered by surfaces 2*a*, 2*b*. The other two facing lateral surfaces 2*c*, 2*d* of base 2 are fitted with a central slot 6*c* (see FIG. 2) to allow mechanical interaction with an auxiliary contact add-on 12 (see FIGS. 1 and 3) that is described below, together with slots and apertures 6*b* for positioning or clipping the add-on.

Starting from front surface 3*a* that covers the front of the switch, body 3 contains a passage 7 that has a circular contour 7*a* at the surface and a polygonal contour 7*b* inside. The polygonal contour 7*b* is fitted with ratchet components 8 such as flexible levers for retaining matching shapes 4*a* provided on a cylindrical surface 4*b* of the handle. The handle is also fitted with an activating component 4*c*. Between activating component 4*c* and surface 4*b* is a square-shaped plate 4*d*. The handle also has an activating rod 4*e* whose end is polygonal in cross-section to fit a cylindrical core that is described below. Since the handle has a ratchet fitting, the required handle can easily be fitted to the switch.

Body 3 is fitted with ears 10 equipped with fastening apertures 11 for threaded screws or rods connected to plate 4*d* so that the handle can be fastened to the housing and/or so that the handle subassembly may be fastened to an intermediate surface or plate. The rear of base 2 has the usual components 2*e* to enable it to be clipped onto a standard section.

To make it possible to work on terminals 6 both from the front and the back of the switch, housing 1 is fitted with a recess 9 in the front of surfaces 2*a*, 2*b* and each terminal 6 is fitted with two coaxial screws accessible respectively from the front via recess 9 and from the rear as described below.

A control core 13 is fitted into passage 7 so that it can rotate around axis X without axial displacement (see FIGS. 4 to 8). Said core is provided with a square aperture 13*a* and, on two opposite sides, rounded control projections or lugs 14 of minimized radial width that are connected to the part of the core near the aperture by a stop face 14*a* parallel to X and an oblique face 14*b*. The core is retained in direction X on the handle side by a shoulder 3*e* in body 3 (see FIG. 7).

A slider 16 is disposed so that it can move parallel to X and is guided through body 3 by ribs 17 disposed appropriately in the body. The front of the slider is provided with a cylindrical receptacle head 18 that is constructed to match core 13 and has a cross-section more or less identical to that of core 13. Cylindrical receptacle 18 is fitted with pairs of facing cam notches 19, 20 that are disposed around axis X and shaped to match the control projections 14. The thickness of the walls of the receptacle is more or less the same as the radial width of control projections 14.

It should be noted that the depth of all the ON notches 19 in axis X is greater than that of the adjacent OFF notches 20 that are offset in relation to notches 19 by a 90° rotation around axis X and that the bottom of each notch 19, 20 is constructed to make contact with control projection 14. Notch 19 has a straight side 19*a* parallel with main axis X' and an oblique side 19*b* more or less parallel with oblique face 14*b*. Similarly, notch 20 has a straight side 20*a* parallel with axis X and an oblique side 20*b*. Oblique side 20*b* meets oblique side 19*b* at reversing peak 18*a*. Straight sides 19*a*, 20*a* coordinate with stop face 14*a* of core 13 to halt rotation and peak 18*a* ensures the transition from one notch to the next as the knob is rotated. Slider 16 is fitted with grooves 16*a* that open towards the base, each groove housing a movable contact bridge 21 and the upper end of the contact pressure spring 22 of the bridge. The other end of each spring 22 presses against a lower surface 2*f* of base 2. Slider 16 is provided with lateral apertures 23 to provide movable contact with add-on 12.

The slider is also moved towards the core by two auxiliary lateral springs 24. One end of each spring is mounted on shanks 16*b* of the slider while the other end presses against lower surface 2*f* of the base. The slider is thus pressed against the core by the combined force of contact pressure springs 22 and auxiliary springs 24. It will be understood that contact bridges may easily be inserted during assembly into grooves 16*a* parallel to main axis X'. The lower surface 2f of base 2 has a suitable shape 2*g* to house the ends of springs 22, 24.

Passages are provided in the lateral surfaces 3*a*, 3*b* of body 3. These passages face surfaces 2*a*, 2*b* of the base. Fixed contacts 25 are inserted into said passages such that they are level with the front of passages 5 and coordinate with movable contact bridges 21. Each terminal 6 consists of a cage 26 located in cavity 6*a* that opens into a passage 5. The forward section of the cage has a threaded orifice 27 while the rear section has a threaded orifice 28. Screws 29, 30 that can be adjusted respectively from the front via aperture 31 in the body, and from the rear via aperture 32 in the base are fitted into orifices 27, 28.

Cables inserted into passage 5 are gripped either by moving the cage or a screw forward. When screw 29 is used, the translational movement of the screw is fixed as it meets stop 3*f* of body 3 and the cage moves in the direction shown by arrow F towards the front of the switch so that the cable is gripped between the cage and component 25. When screw 30 is used, the translational movement of the screw is in the direction of arrow F while the cage remains static and the cable is gripped between the end of the screw and component 25. Apertures 32 open to the rear of the base near the components 2*e* used to fasten base 2 to a standard section.

Add-ons 12 comprise a housing 33 containing dualscrew terminals 34 similar or identical to dual-screw terminals 6 of the switch. The add-on may consist of a movable contact bridge 21*a* and fixed contact 25*a*. Movement of the movable contact bridge 21*a* is controlled by a component that interacts via slot 6*c* with openings 23 of slider 16. The front of housing 33 of the add-on is fitted with openings 35 and its rear with apertures 36 for moving terminals 34. Add-on 12 is preferably constructed and fitted to be reversible in relation to surface 2*c*, 2*d* so that it is capable of occupying two positions 180° from one another, thereby acting as an open add-on in the first position (i.e., U-shaped member 37 opens upward) and a closed add-on in the second position (i.e., U-shaped member 37 opens downward).

The assembly and operation of the switch will now be explained with reference to FIGS. 4 to 8.

Once the fixed contacts are inserted into body 3 and the terminals 6 introduced into lateral cavities 6*a* in the body, the subassemblies consisting of the control core 13, slider 16, contact pressure springs 22 and auxiliary springs 24 are introduced into passage 7. The base 2 is then inserted and clipped onto body 3, thereby trapping the terminals. Handle 4 may then be fitted.

When the switch is in the OFF position (FIG. 4), the peak of control projection 14 presses against the bottom of shallow notch 20 so that the slider is moved towards the bottom of base 2 and springs 22, 24 are compressed. Contact bridges 21 are pressed against the bottom of grooves 16*a* by springs 22.

When the switch is brought into the ON position (FIG. 5) by turning handle 4 through 90°, the peak of control projection 14 goes beyond reversing peak 18*a* located between notches 19, 20 to press against the bottom of deep notch 19 because springs 22, 24 push the slider towards handle 4. Contact bridges 21 are then pressed against the fixed contact components and clear of the bottom of grooves 16*a* by a slight distance.

We claim:

1. Rotary-controlled multipole electric switch having an ON position and an OFF position, comprising a housing fitted with a control handle rotatable about a rotational axis, said housing including several movable contact bridges disposed in a slider, said slider being capable of translational movement, a core having a cam, said core rotating with the rotating handle and the cam coordinates with the slider to translate the slider, a cam follower on the slider comprising at least two notches offset in relation to one another around the axis of rotation of the handle, the cam comprising at least one control projection that in the ON position is pressed against one of the notches and in the OFF position is pressed against another of said notches by the force exerted by springs on the slider.

2. Switch of claim 1 wherein the notches are unequal in length along a main axis of the switch parallel to the axis of rotation of the handle.

3. Switch of claim 1 wherein the slider comprises grooves that open along a main axis parallel to the axis of rotation of the handle facing the handle and housing contact bridges, pressure contact springs exerting force on the housing and the bridges ensuring that the control projection presses against the notches.

4. Switch of claim 1 comprising a pair of control projections fitted to the core and a pair of the notches are fitted to a cylindrical receptacle head of the slider, the core and the head being of approximately equal diameter with the core being rotatable within the head.

5. Switch of claim 1 wherein connection terminals accessible from the front and rear along a main axis parallel to the axis of rotation of the handle are provided in the housing.

6. Switch of claim 5 wherein the housing comprises a base and a body and the connection terminals are located between one aperture formed towards the front in the body and another aperture formed towards the rear in the base.

7. Switch of claim 5 wherein each terminal comprises a cage fitted with two screws arranged such that in order to grip a cable, one screw remains static in translation while the other screw moves translationally.

8. Switch of claim 1 wherein the housing comprises a passage for an activating rod for the handle, one surface of the handle being in the shape of ratchet to coordinate with flexible ratchet components located in the passage.

9. Switch of claim 1 wherein at least one reversible add-on with an aperture or closing functions may be clipped onto one surface of the housing.

* * * * *